US006113017A

United States Patent [19]

Tsai

[11] Patent Number: 6,113,017

[45] Date of Patent: Sep. 5, 2000

[54] PAPER SHREDDER WITH A SAFE IMPELLING ROLLER

[75] Inventor: Jeff Tsai, No. 17, Lane 267, Hua-Cheng Rd., Hsinchuang City, Taipei Hsien, Taiwan

[73] Assignee: Jeff Tsai, Taipei-Hsien, Taiwan

[21] Appl. No.: 09/375,790

[22] Filed: Aug. 17, 1999

[30] Foreign Application Priority Data

Jun. 4, 1999 [TW] Taiwan ..... 88209158

[51] Int. Cl.[7] ..... B02C 1/08

[52] U.S. Cl. ..... 241/236; 241/36; 241/37.5

[58] Field of Search ..... 241/36, 37.5, 236, 241/100

[56] References Cited

U.S. PATENT DOCUMENTS

| | | | |
|---|---|---|---|
| 4,349,159 | 9/1982 | Hardwick et al. | 241/236 |
| 4,351,485 | 9/1982 | Hardwick et al. | 241/36 |
| 4,957,243 | 9/1990 | Kanagaki et al. | 241/34 |
| 5,014,920 | 5/1991 | Schwelling | 241/101.2 |
| 5,163,629 | 11/1992 | Raterman et al. | 241/236 |
| 5,213,274 | 5/1993 | Lodovico | 241/222 |
| 5,328,107 | 7/1994 | Tsai | 241/295 |
| 5,362,002 | 11/1994 | Tsai | 241/222 |
| 5,375,782 | 12/1994 | Schwelling | 241/166 |
| 5,474,243 | 12/1995 | Schwelling | 241/166 |
| 5,775,605 | 7/1998 | Tsai | 241/36 |

*Primary Examiner*—Joseph J. Hail, III
*Assistant Examiner*—William Hong
*Attorney, Agent, or Firm*—Hoffman & Baron, LLP

[57] ABSTRACT

A paper shredder includes a casing, an impelling roller, and a clutch mechanism. The casing has a pair of shredding rollers mounted rotatably therein. The impelling roller is disposed rotatably below and is adjacent to the shredding rollers. The clutch mechanism is provided for connection of the shredding rollers and the impelling roller to transmit rotation of the shredding rollers to the impelling roller, and for disconnection of the shredding rollers and the impelling roller when an external force is exerted on the impelling roller to slow down the impelling roller with respect to the shredding rollers.

7 Claims, 5 Drawing Sheets

PAPER SHREDDER WITH A SAFE IMPELLING ROLLER

BACKGROUND OF THE INVENTION

1. Field of the Invention

This invention relates to a paper shredder, more particularly to a paper shredder having an impelling roller that makes the paper shredder safe to use.

2. Description of the Related Art

U.S. Pat. No. 5,362,002 discloses a paper shredder having a pair of shredding rollers and an impelling roller disposed below and adjacent to the shredding rollers. The impelling roller has a driven gear connected to an end thereof and meshing with one of driving gears connected to the shredding rollers, so that the impelling roller can be driven rotatably by the shredding rollers. The impelling roller is adapted to remove pieces of paper trapped between the shredding rollers and to propel shredded paper to an exit slot. The impelling roller also conceals the shredding rollers to prevent access thereto, thereby making the paper shredder safe to use. However, it is possible for the user to be injured when his hand contact the impelling roller during operation.

SUMMARY OF THE INVENTION

The object of the present invention is to provide a paper shredder having an impelling roller that is safe to use.

According to the present invention, the paper shredder includes a casing, an impelling roller, and a clutch mechanism. The casing has a pair of shredding rollers mounted rotatably therein. The impelling roller is disposed rotatably below and is adjacent to the shredding rollers. The clutch mechanism connects the shredding rollers and the impelling roller to transmit rotation of the shredding rollers to the impelling roller, and disconnects the shredding rollers and the impelling roller when an external force is exerted on the impelling roller to slow down the impelling roller with respect to the shredding rollers.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
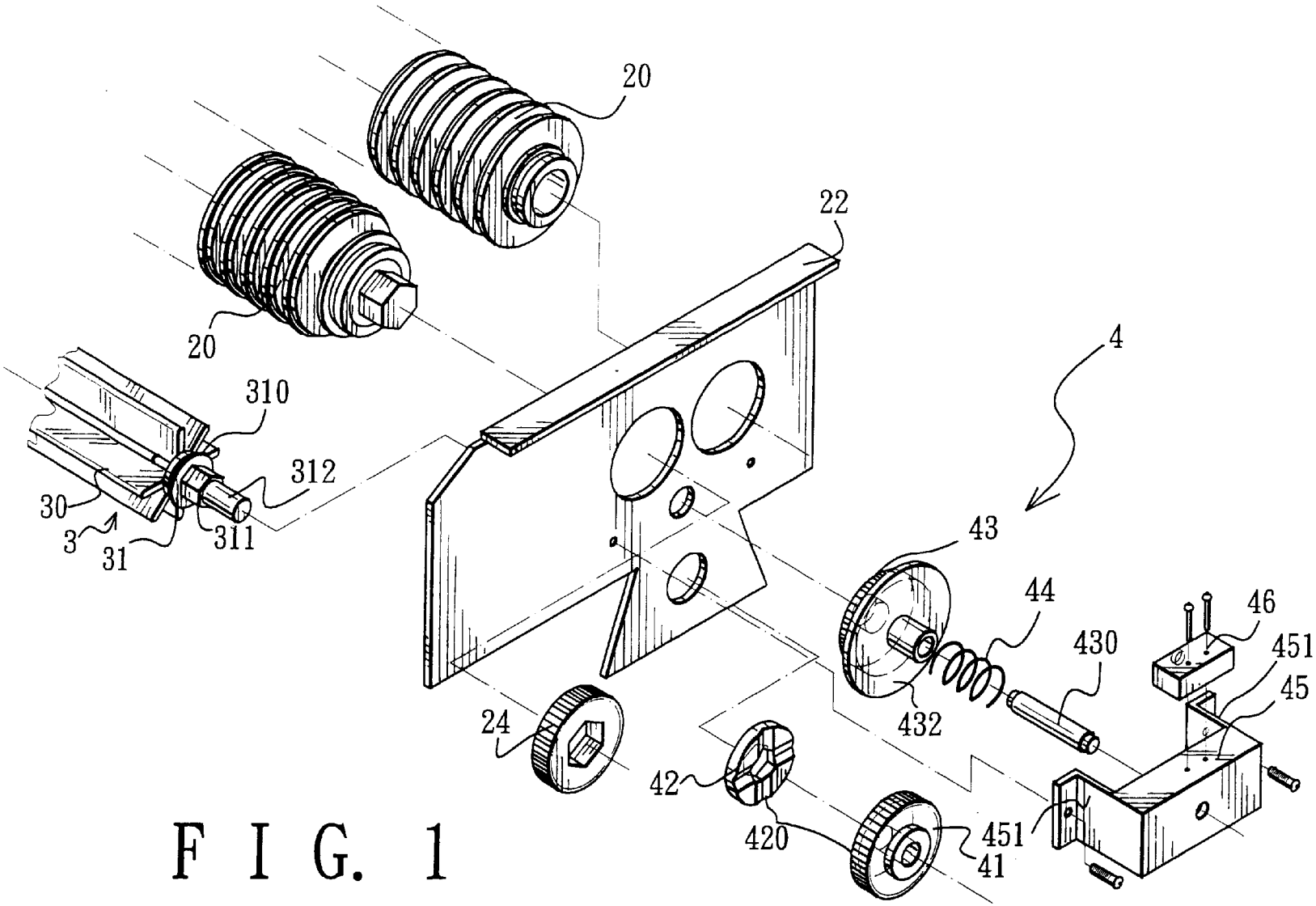
FIG. 1 is a fragmentary exploded view of a part of a first preferred embodiment of a paper shredder according to the present invention.

Before the present invention is disclosed in greater detail, it should be noted that like elements are denoted by the same reference numerals throughout the disclosure.

Figure 2:
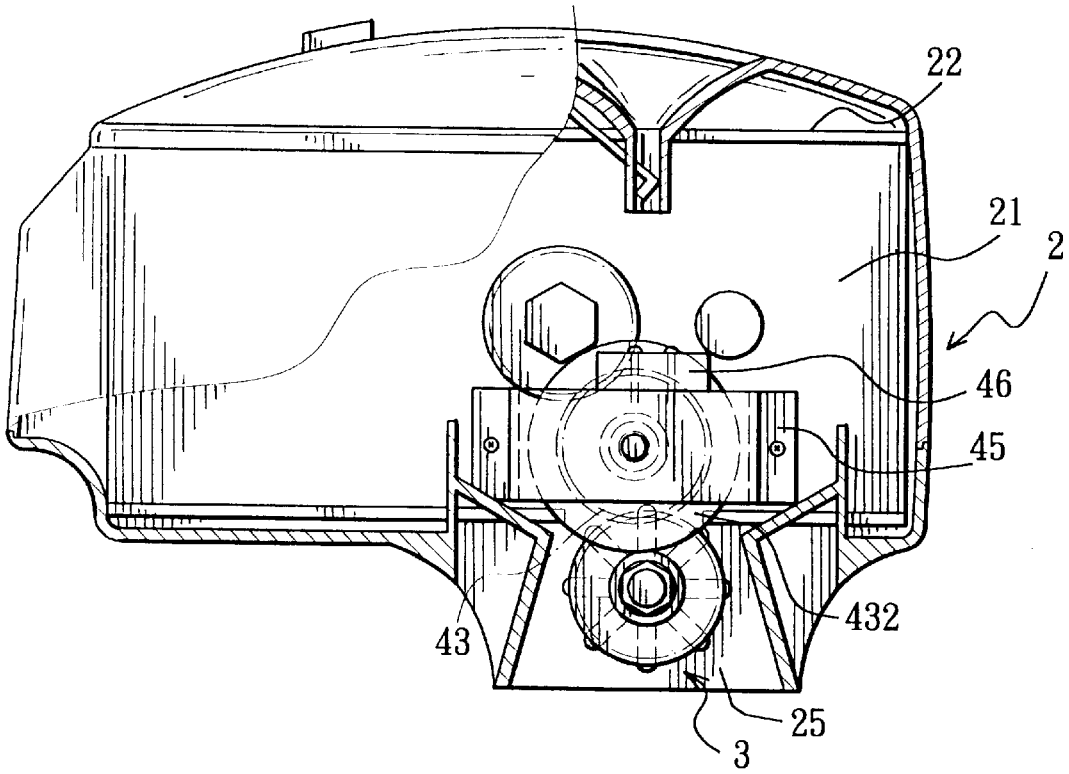
FIG. 2 is a sectional side view of the first preferred embodiment of the paper shredder according to the present invention.
Figure 3:
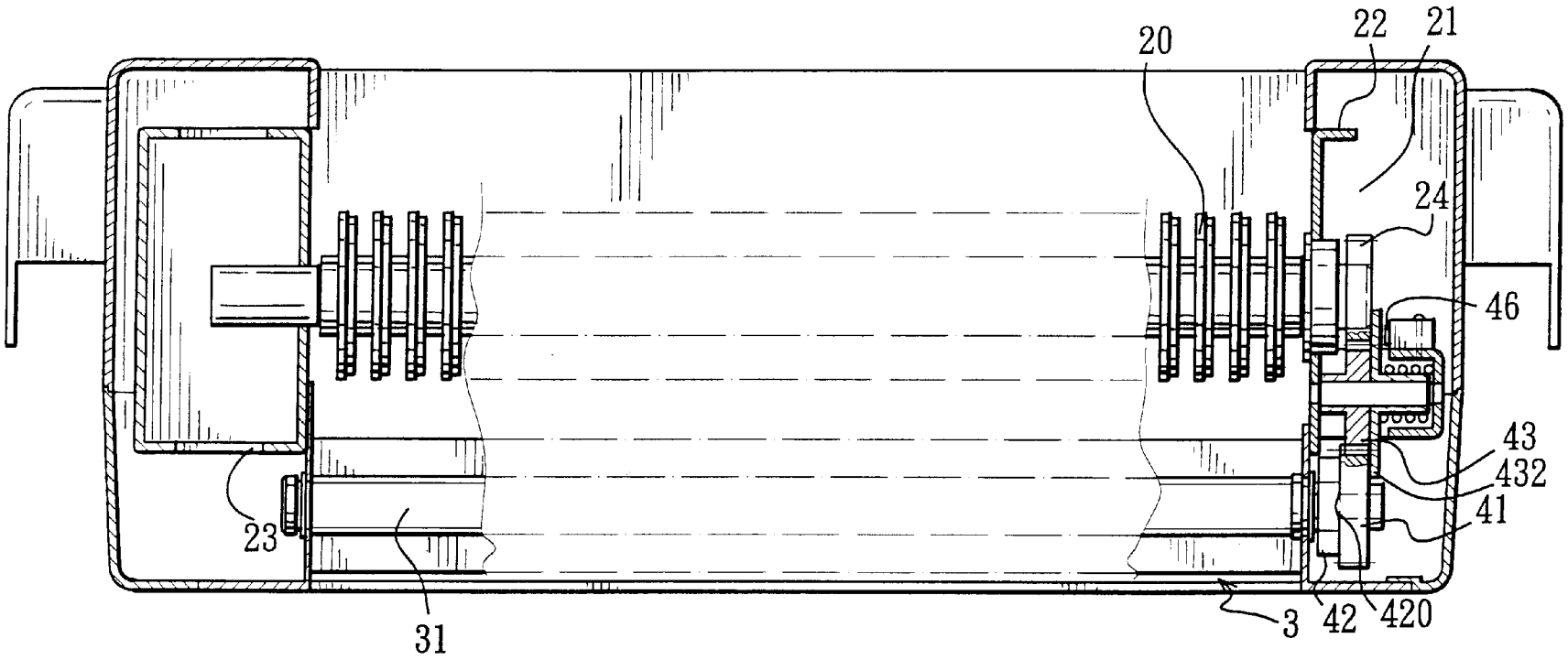
FIG. 3 is a sectional front view of the first preferred embodiment of the paper shredder according to the present invention.
Figure 4:
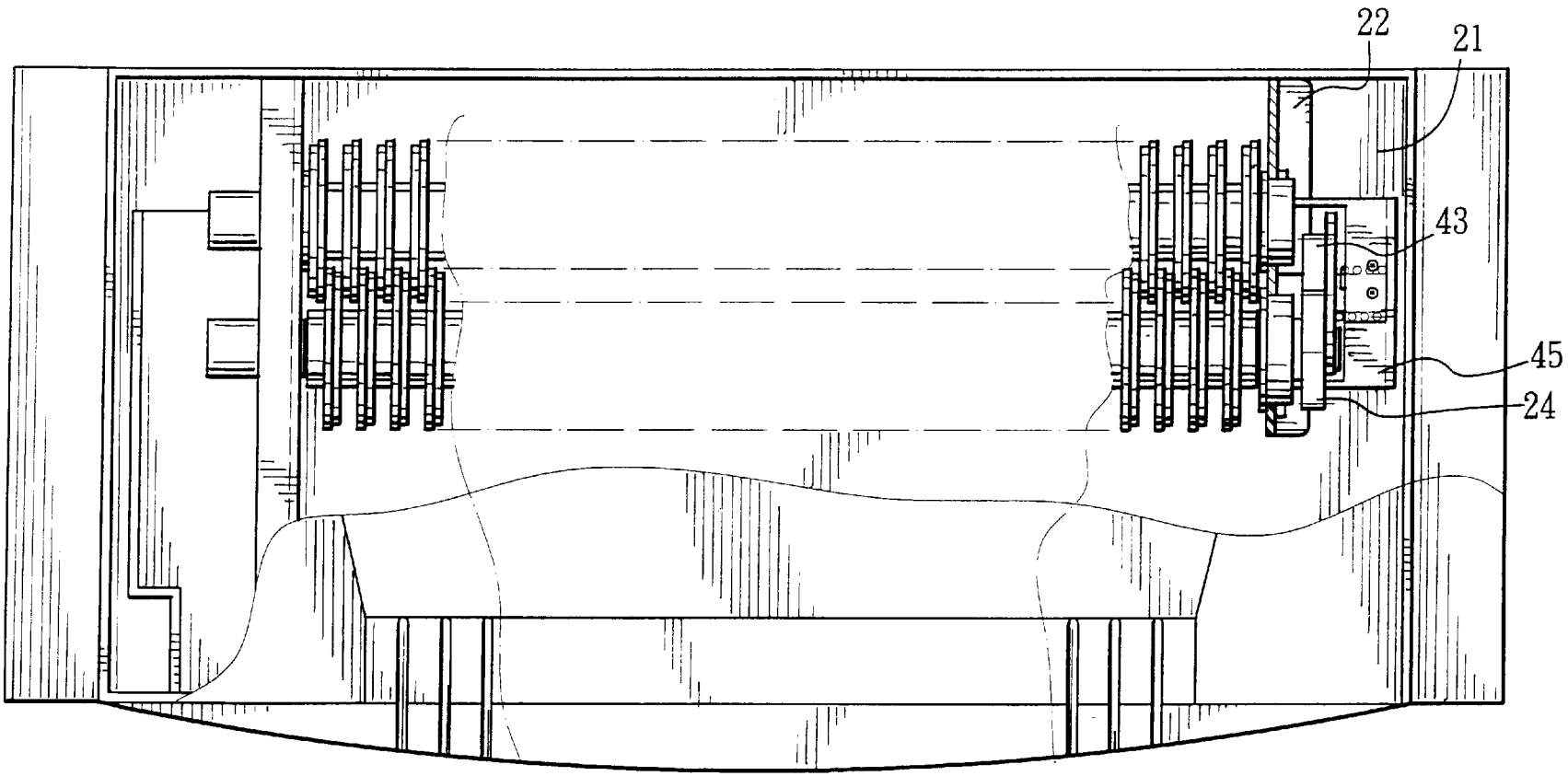
FIG. 4 is a sectional top view of the first preferred embodiment of the paper shredder according to the present invention.

Referring to FIGS. 1 and 2, a first preferred embodiment of a paper shredder according to the present invention is shown to include a casing 2, an impelling roller 3, and a clutch mechanism 4. The casing 2 has a pair of shredding rollers 20 mounted rotatably therein. The impelling roller 3 is disposed rotatably below and is adjacent to the shredding rollers 20 in a known manner. The clutch mechanism 4 connects the shredding rollers 20 and the impelling roller 3 to transmit rotation of the shredding rollers 20 to the impelling roller 3, and disconnects the shredding rollers 20 and the impelling roller 3 when an external force is exerted on the impelling roller 3 to slow down the impelling roller 3 with respect to the shredding rollers 20, as will be discussed in greater detail hereinbelow.

Referring to FIGS. 1, 2, 3 and 4, the casing 2 has two opposed mounting plates 22, 23 fixed therein, and a receiving space 21 formed between one of the mounting plates 22 and an internal wall of the casing 2. The shredding rollers 20 are mounted rotatably between the mounting plates 22, 23. One of the shredding rollers 20 has a driving gear 24 fixed to an end that is adjacent to the mounting plate 22.

The impelling roller 3 has a rotary shaft 31 and a plurality of angularly spaced and radially extending blades 30 formed on the rotary shaft 31. The blades 30 of the impelling roller 3 propel shredded paper to an exit slot 25 in the casing 2 and conceal the shredding rollers 20 to prevent access thereto. The rotary shaft 31 has one end portion that extends through the mounting plate 22, and that has a first section 310 of a larger circular cross-section, a second section 311 of a polygonal cross-section, and a third section 312 of a smaller circular cross-section connected in succession. The first section 310 is connected rotatably to the mounting plate 22. The other end portion of the rotary shaft 31 is mounted rotatably on the mounting plate 23.

The clutch mechanism 4 includes a driven disc 42 fixed to the second section 311 of the rotary shaft 31, a driven gear 41 mounted coaxially on the third section 312 of the rotary shaft 31 and rotatable and slidable with respect thereto, and a transmission gear 43 mounted rotatably on a transmission shaft 430 that is parallel to the rotary shaft 31. The transmission shaft 430 is positioned between the mounting plate 22 and a U-shaped support 45 that has two legs 451 fixed to the mounting plate 22. A thrust disc 432 is mounted rotatably on the transmission shaft 430 and is connected coaxially to the transmission gear 43. First and second engaging members 420 are formed respectively on a first side face of the driven disc 42 and a second side face of the driven gear 41 that confronts the first side face of the driven disc 42, and are inter-connectable with one another. A coiled spring 44 is sleeved on the transmission shaft 430 between the thrust disc 432 and the U-shaped support 45 to bias the thrust disc 432 to push the driven gear 41 to abut against the driven disc 42 so as to interengage the first and second engaging members 420. The transmission gear 43 interengages the driven gear 41 and the driving gear 24 to permit transmission of rotation of the shredding rollers 20 to the impelling roller 3. The first and second engaging members 420 push each other in a camming action to push the driven gear 41 to move away from the driven disc 42 when an external force is exerted on the impelling roller 3 to slow down the impelling roller 3 with respect to the shredding rollers 20. Therefore, when the user's hand touches the impelling roller 3 and exerts an external force on the same, the clutch mechanism 4 can disconnect a power transmitted from the shredding rollers 20 to the impelling roller 3, thereby protecting the user's hand from being injured.

Preferably, a contact switch 46 is provided on the U-shaped support 45 for deactivating the shredding rollers

20. The thrust disc 432 contacts and activates the contact switch 46 when the driven gear 41 moves away from the driven disc 42 to push the thrust disc 432 against the coiled spring 44. In this way, the paper shredder can be shut down to prevent injury to the user.

Figure 5:
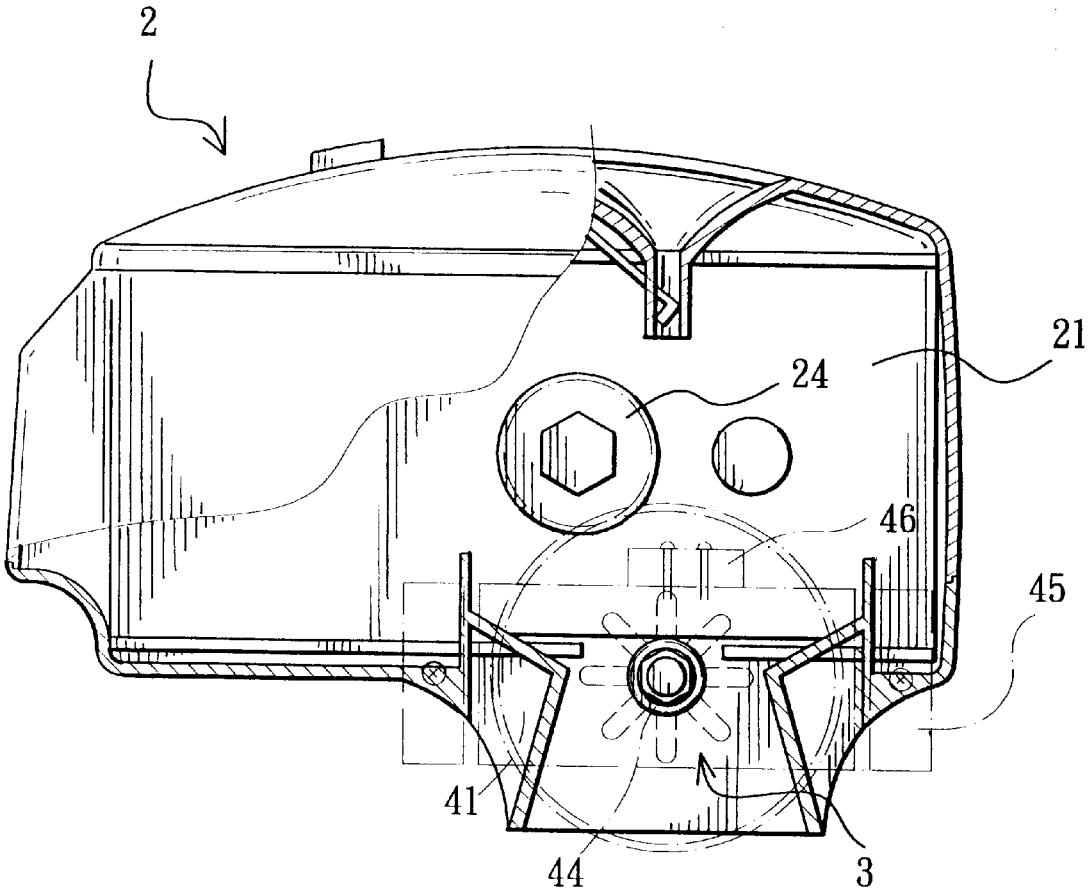
FIG. 5 is a sectional side view of a second preferred embodiment of a paper shredder according to the present invention.

FIG. 5 shows a second preferred embodiment of a paper shredder according to the present invention. In this embodiment, the transmission gear 43 and the thrust disc 432 of the first embodiment are eliminated, and the driven gear 41 meshes directly with the driving gear 24. The coiled spring 44 is disposed between the driven gear 41 and the U-shaped support 45 in order to bias the driven gear 41 to abut against the driven disc 42. The driven gear 41 contacts and activates the contact switch 46 on the U-shaped support 45 when the driven gear 41 moves away from the driven disc 42 in a manner similar to that described in the first preferred embodiment.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A paper shredder, comprising:

a casing having a pair of shredding rollers mounted rotatably therein;

an impelling roller disposed rotatably below and adjacent to said shredding rollers; and a clutch mechanism for connection of said shredding rollers and said impelling roller to transmit rotation of said shredding rollers to said impelling roller, and for disconnection of said shredding rollers and said impelling roller when an external force is exerted on said impelling roller to slow down said impelling roller with respect to said shredding rollers.

2. The paper shredder as claimed in claim 1, wherein one of said shredding rollers has a driving gear fixed thereto, said impelling roller having a rotary shaft, said clutch mechanism having a driven disc fixed to said rotary shaft, a driven gear mounted coaxially on said rotary shaft and rotatable and slidable with respect to said rotary shaft, a first engaging member formed on said driven disc, and a second engaging member formed on said driven gear and connectable with said first engaging member, said driven gear being biased to abut against said driven disc to interengage said first and second engaging members, said driven gear engaging said driving gear to permit transmission of rotation of said shredding rollers to said impelling roller, said first engaging member camming said second engaging member to push said driven gear to move away from said driven disc when the external force is exerted on said impelling roller.

3. The paper shredder as claimed in claim 2, wherein said driven disc has a first side face on which said first engaging member is formed, said driven gear having a second side face confronting said first side face and having said second engaging member formed thereon.

4. The paper shredder as claimed in claim 3, further comprising a contact switch for deactivating said shredding rollers, said driven gear contacting and activating said contact switch when said driven gear moves away from said driven disc.

5. The paper shredder as claimed in claim 1, wherein one of said shredding rollers has a driving gear fixed thereto, said impelling roller having a rotary shaft, said clutch mechanism having a driven disc fixed to said rotary shaft, a driven gear mounted coaxially on said rotary shaft and rotatable and slidable with respect to said rotary shaft, a transmission shaft parallel to said rotary shaft, a transmission gear mounted rotatably on said transmission shaft, a thrust disc mounted rotatably on said transmission shaft and connected to said transmission gear, a first engaging member formed on said driven disc, and a second engaging member formed on said driven gear and connectable with said first engaging member, said thrust disc being biased to push said driven gear to abut against said driven disc in order to interengage said first and second engaging members, said transmission gear interengaging said driven gear and said driving gear to permit transmission of rotation of said shredding rollers to said impelling roller, said first engaging member camming said second engaging member to push said driven gear to move away from said driven disc when the external force is exerted on said impelling roller.

6. The paper shredder as claimed in claim 5, wherein said driven disc has a first side face on which said first engaging member is formed, said driven gear having a second side face confronting said first side face and having said second engaging member formed thereon.

7. The paper shredder as claimed in claim 6, further comprising a contact switch for deactivating said shredding rollers, said thrust disc contacting and activating said contact switch when said driven gear moves away from said driven disc.

* * * * *